US010892129B2

(12) United States Patent
Wang et al.

(10) Patent No.: US 10,892,129 B2
(45) Date of Patent: Jan. 12, 2021

(54) ARC-PREVENTING FAST-BREAKING SURGE PROTECTION DEVICE

(71) Applicant: GUANGXI NQT ELECTRONIC TECHNOLOGY CO., LTD, Guangxi (CN)

(72) Inventors: Zhan Wang, Guangxi (CN); Yuanli Pan, Guangxi (CN); Xingying Huang, Guangxi (CN); Moxiao Feng, Guangxi (CN); Qingjie Liang, Guangxi (CN); Shouning Huang, Guangxi (CN)

(73) Assignee: GUANGXI NQT ELECTRONIC TECHNOLOGY CO., LTD, Nanning (CN)

( * ) Notice: Subject to any disclaimer, the term of this patent is extended or adjusted under 35 U.S.C. 154(b) by 0 days.

(21) Appl. No.: 16/302,668

(22) PCT Filed: May 5, 2017

(86) PCT No.: PCT/CN2017/083295
§ 371 (c)(1),
(2) Date: Nov. 18, 2018

(87) PCT Pub. No.: WO2017/198080
PCT Pub. Date: Nov. 23, 2017

(65) Prior Publication Data

US 2019/0295799 A1 Sep. 26, 2019

(30) Foreign Application Priority Data

May 17, 2016 (CN) ..... 2016 1 0325191

(51) Int. Cl.
*H01H 85/38* (2006.01)
*H01H 85/00* (2006.01)
(Continued)

(52) U.S. Cl.
CPC ..... *H01H 85/38* (2013.01); *H01C 7/10* (2013.01); *H01C 7/12* (2013.01);
(Continued)

(58) Field of Classification Search
CPC ..... H01H 85/38; H01H 85/0047; H01H 85/0241; H01H 85/20; H01H 85/306;
(Continued)

(56) References Cited

U.S. PATENT DOCUMENTS 4,996,509 A * 2/1991 Bernstein ..... H01H 85/143 337/232
5,300,914 A * 4/1994 Hartman ..... H01H 85/055 337/217
(Continued)

FOREIGN PATENT DOCUMENTS

CN 101261893 A 9/2008
CN 101741081 A 6/2010
(Continued)

OTHER PUBLICATIONS

International Search Report of PCT Patent Application No. PCT/CN2017/083295 dated Aug. 16, 2017.

*Primary Examiner* — Stephen S Sul

(57) ABSTRACT

An arc-preventing fast-breaking surge protection device is disclosed. In one of implement, surge protection device includes an arc-preventing assembly consisted of an arc-preventing catapult and an elastic element, comprising a voltage sensitive assembly, a response switch assembly, a thermosensitive element, an inner shell and an outer cover. The voltage sensitive assembly is tightly coupled with the response switch assembly. When the instantaneous surge voltage in circuits causes the voltage sensitive assembly to continuously heat up due to the fault short-circuit current, the response switch assembly causes the arc-prevent assembly to be catapulted and separated by the thermal coupling
(Continued)

response of the thermosensitive element, meanwhile the response switch assembly is conceal by the arc-preventing assembly, thus preventing the arc generated when the switch is s catapulted and separated from forming a short-circuit and an overload, thus effectively avoiding fire and explosion hazards and further preventing secondary damage of electronic devices.

8 Claims, 17 Drawing Sheets

(51) Int. Cl.

| | |
|---|---|
| ***H01H 85/02*** | (2006.01) |
| ***H01H 85/20*** | (2006.01) |
| ***H01H 85/30*** | (2006.01) |
| ***H01H 85/36*** | (2006.01) |
| ***H01C 7/10*** | (2006.01) |
| ***H01C 7/12*** | (2006.01) |

(52) U.S. Cl.
CPC .... *H01H 85/0047* (2013.01); *H01H 85/0241* (2013.01); *H01H 85/20* (2013.01); *H01H 85/306* (2013.01); *H01H 85/36* (2013.01)

(58) Field of Classification Search
CPC . H01H 85/36; H01C 7/10; H01C 7/12; H01C 1/144; H02H 3/04; H02H 9/08
USPC ... 337/49, 62, 110, 148, 183, 187, 273, 354, 337/408
See application file for complete search history.

(56) References Cited

U.S. PATENT DOCUMENTS

| | | | | |
|---|---|---|---|---|
| 6,430,019 | B1 * | 8/2002 | Martenson | H01C 7/126 361/103 |
| 7,839,257 | B2 * | 11/2010 | Cernicka | H01C 7/126 337/142 |
| 2008/0130180 | A1 * | 6/2008 | de Palma | H01C 7/112 361/56 |
| 2009/0079535 | A1 * | 3/2009 | Jeong | H01C 1/022 338/21 |
| 2011/0170217 | A1 * | 7/2011 | Mao | H01C 7/126 361/2 |
| 2012/0050935 | A1 * | 3/2012 | Douglass | H01C 7/126 361/103 |
| 2012/0068806 | A1 * | 3/2012 | Guarniere | H01C 7/10 337/1 |
| 2013/0038976 | A1 * | 2/2013 | Hagerty | H01C 7/126 361/104 |
| 2014/0313632 | A1 * | 10/2014 | Hirschmann | H01C 7/12 361/131 |
| 2017/0110226 | A1 * | 4/2017 | Hirschmann | H01C 7/12 |
| 2017/0222426 | A1 * | 8/2017 | Mao | H02H 3/085 |

FOREIGN PATENT DOCUMENTS

| | | |
|---|---|---|
| CN | 102916419 A | 2/2013 |
| CN | 203761042 U | 8/2014 |
| CN | 204204540 U | 3/2015 |

* cited by examiner

ARC-PREVENTING FAST-BREAKING SURGE PROTECTION DEVICE

FIELD OF THE INVENTION

The present invention relates to a circuit protection device, in particular to a surge protection device having functions of arc-preventing and fast-breaking under a short circuit and overloading current.

BACKGROUND OF THE INVENTION

Surge protectors or surge suppressors, also known as surge protection device, provide protection against overvoltage for electronic components of various sensitive or expensive electronic devices, such as computers and communication-related equipment. The existing surge protection devices are usually designed for surge overvoltage protection under medium or general conditions, so when the surge overvoltage energy is small or lasting time is short, the surge protection device cannot be rapidly responsive. As a result, voltage-sensitive protection components (such as piezoresistors) are usually directly applied to electronic circuits to protect the electronic circuit. Conventional varistors are electronic devices consisting of zinc oxide particles and complex intracrystalline particles, which are voltage nonlinear devices and ideal protection devices for sensitive electronic circuits due to the unique voltage and current characteristics. However, due to the material composition, it is determined that it is extremely vulnerable to breaking down and igniting during overvoltage and short circuit and overloading, thus causing catastrophic damage to nearby sensitive electronic circuits and components. Therefore, it needs a safer and more sensitive surge protection device that can be used in the protection of surge over-voltage, short-circuit and overloading for high-precision control circuits such as communication devices, computers, televisions, air conditioners, etc. For example, a transient peak current or an overvoltage is generated in electronic circuits because of the extra electromagnetic interference, the surge protection device can instantaneously conduct, absorb and discharge the surge voltage to protect the electronic devices, and can rapidly separate the surge protection device when the surge device is damaged by short circuit and overloading, thus avoiding fire and catastrophic damage to electronic devices.

So far, the existing surge protectors or surge suppressors with arc extinguishing function generally adopts method shielding and cutting off arc to extinguish arc. For example, Chinese Patent No. 200810088691.X discloses a thermal protection piezoresistor module and Chinese patent No. 201420145977.8 discloses a surge suppressor with arc extinguishing function, in which shielding and cutting off the arc is applied for thermally separating the switching electrode of the response switch assembly. In this method, the arc shielding mechanism needs a stroke to reach the position to shield and cut off the arc, and then the arcing shielding mechanism cannot enter the gap of the switch electrode to cut off the arc at the moment of switch separating. Therefore, the piezoresistor under the conditions will be instantaneously overloaded, overheat, thus finally causing fire and explosion. Such catastrophic damage will burn nearby sensitive electronic devices and components, leading the entire electronic system to collapse and damage.

BRIEF SUMMARY OF THE INVENTION

The object of the present invention is to overcome the defects and deficiencies of the existing surge protection device in situation of overvoltage leading to shout circuit and overload of the device, and provide a novel fast response surge protection device, which can effectively prevent arc generation and separate the surge protection device under shout circuit and overload, thus fire hazard can be fundamentally eliminated to ensure the safety of the electronic device.

In order to achieve the above purposes, the invention is realized through the following technical solutions.

The present invention provides an arc-preventing fast-breaking surge protection device, wherein the device comprises an arc-preventing assembly, a voltage sensitive assembly, electrode pins, a response switch assembly and a housing consisted of an inner shell and an outer cover. The arc-preventing assembly comprises an arc-preventing catapult and an elastic element; the voltage sensitive assembly comprises at least one voltage sensitive element; the electrode pins comprising a flexible conductor, a first electrode pin and a second electrode pin; the response switch assembly comprises a thermosensitive element, a front electrode and a tripping electrode, the tripping electrode being consist of a movable electrode slice, a electrode welding end and a breaking section, the breaking section being respectively electrically connected the movable electrode slice and the electrode welding end.

A first cavity and a second cavity are formed when the inner shall is engaged with the outer cover, and the arc-preventing assembly and the response switch assembly is arranged in the first cavity. The voltage sensitive element is consisted of sensitive components such as varistor sensitive component, discharge tubular sensitive component or discharge gap sensitive component, which is arranged in the second cavity. Two metal electrode slice are respectively disposed on both sides of the voltage sensitive element, and the front electrode is disposed on one of the metal electrode slices, the front electrode protrudes from the second cavity to the first cavity, the front electrode is provided with a slotted hole out of which the electrode welding end extends; the other metal electrode sheet is provided with a back electrode, the back electrode is in the second cavity A front end of the arc-preventing catapult is provided with a through hole out of which the electrode welding end protrudes; when the arc-preventing catapult contacts with the front electrode in the first cavity, the through hole faces the position of the slotted hole to ensure the electrode welding end protrudes to simultaneously pass through the through hole and the slotted hole.

The breaking section is a metal alloy material which is vaporized instantaneously after melting, when an instantaneous surge overvoltage, an overcurrent, a short circuit current or an overload current through the tripping electrode exceeds a preset melting temperature, the breaking section of the tripping electrode instantaneously melts and vaporizes so that movable electrode slice separates from the electrode welding end, thus realizing fast breaking function of the surge protection device under a short circuit and an overload.

The arc-preventing catapult is provided with an exhaust vent, when the tripping electrode is disposed in the arc-preventing catapult, the breaking section faces the position of the exhaust vent when the electrode welding end protrudes from the through hole, to ensure that the generated explosive gas wave can be discharged through the exhaust vent when the breaking section is melted and vaporized under the short circuit current or the overload current, and meanwhile, the effect of instantaneously stretching and blowing off the arc can be achieved by taking advantage of the gas wave.

The thermosensitive element is a fusible metal alloy solder, of which a temperature threshold for melting can be preset, and the thermosensitive element will melt rapidly when the preset temperature threshold is reached In one preferred embodiment of the present invention, the arc-preventing fast-breaking surge protection device further comprises an indication module and a remote signaling alarm module for indicating a working state thereof. The indication module is an electrical indicating device, for example, a light emitting diode; or a mechanical indication module. The outer cover is provided with an indication window or indicating a working state of the surge protection device, then the surge protection device has functions of indicating a working state and sending remote signaling alarm. When applying the surge protection device in power system, the tripping electrode is concealed in the arc-preventing catapult, and the electrode welding end protrudes out of the through hole and the slotted hole, which is electrically connected with the front electrode through the thermosensitive element. The first cavity is provided with an inserting groove, and the second cavity is provided with a blocking groove; the first electrode pin enters the first cavity through the inserting groove, and the second electrode pin enters the second cavity through the blocking groove; two ends of the flexible conductor are respectively electrically connected to the movable electrode slice and an inner end of the first electrode pin by metal alloy soldering or spot welding, the back electrode is electrically connected to an inner end of the first electrode pin by metal alloy soldering; an outer end of the first electrode pin and an outer end of the second electrode pin catapult outside the inner shells to form external connection pins. As a result a normally closed working state. Therefore, the response switch assembly and the voltage sensitive assembly are connected in series to form a normally closed working state, and the switch of the remote signaling device is not subjected to external stress under the normal working state of the surge protection device.

Furthermore, with regards to the functions of preventing arc generation and fast breaking under shout circuit and overload, technical explanation will be discussed below.

The elastic element is consisted of a first elastic member and a second elastic member, and the first elastic member is disposed on the arc-preventing catapult, by which the movable electrode slice is misaligned; a second elastic member is disposed in the first cavity, by which the arc-preventing catapult is misaligned. When temperature of the voltage sensitive element is increased due to the short circuit current or the overloading current through circuits and the leakage current because of the aging of the voltage sensitive element, the generated heat is transmitted to the front electrode, thus enabling the thermosensitive element to melt when reaching a preset temperature threshold. The movable electrode slice is rapidly catapulted in the arc-preventing catapult due to an elastic stress of the first elastic member before the electrical arc generates; the arc-preventing catapult is rapidly catapulted in a direction away from the front electrode due to an elastic stress of the second compression spring. The molten thermosensitive element on the electrode welding end is scraped off by the through hole, a sufficiently large dielectric strength is formed between the through hole and the electrode welding end and between the front electrode and electrode welding end, and the tripping electrode and the front electrode are completely isolated from each other.

In another case, when the instantaneous surge overvoltage, overcurrent, short circuit or overload current through the tripping electrode exceeds a preset threshold value, the breaking section of the tripping electrode instantaneously melts and vaporizes so that movable electrode slice separates from the electrode welding end. Simultaneously The movable electrode slice is simultaneously catapulted in a direction away from the electrode welding end due to an elastic stress of the first elastic member and the second elastic member, the arc-preventing catapult is catapulted in a direction away from the front electrode due to an elastic stresses of the second elastic member, wherein the movable electrode slice is concealed in the arc-preventing catapult. As a result, A sufficiently large dielectric strength is formed between the electrode welding end and the movable electrode slice, completely avoiding the arc generated during separation of the movable electrode slice to form an electrical breakdown; in addition, the generated explosive gas wave can be discharged through the exhaust vent in the position of the breaking section and meanwhile, the effect of instantaneously stretching and blowing off the arc can be achieved by taking advantage of the gas wave.

According the above discussion, the working state of the response switch assembly is changed from normally closed to normally open. During the process, the indication module of the surge protection device is moved, the change from the indication window relative to the normal working state can be observed (for example, changing into a red display). Meanwhile the switch of the remote signaling alarm module is subjected to external stress, which causes the switch state to change, thereby sending an electrical signal for indicating protection invalidation of the surge protection device.

The elastic stress of the first elastic member is usually preset to be larger than that of the second elastic member to ensure that the electrode welding end of the tripping electrode can be rapidly catapulted and kept concealed in the arc-preventing catapult at the detachment moment of the tripping electrode of the response switch assembly, thus sufficient insulation strength between the through hole and the tripping electrode will be kept.

Compared with the prior art, the advantages of the present invention is as follows:

The arc-preventing fast-breaking surge protection device of the invention has the protection functions of catapulting and breaking under situations of transient temperature rising (such as the leakage current generated by the aging of its own life), the transient over-voltage, the transient short-circuit and the transient overload. When the catapulting and separating occur as transient temperature rises, the tripping electrode of the response switch assembly can be concealed; or when the catapulting and separating occur during the transient over-voltage, the transient short-circuit and the transient overload short circuit and overloading, the generated explosive gas wave during breaking of the tripping electrode can be stretched and further blow off the arc. Regardless of the breaking modes, the protection device can instantaneously realize breaking and concealing the tripping electrode, and an effective dielectric strength is formed before the arc is generated, completely preventing arc generation, which is not available in the exiting surge protection device.

Figure 1:
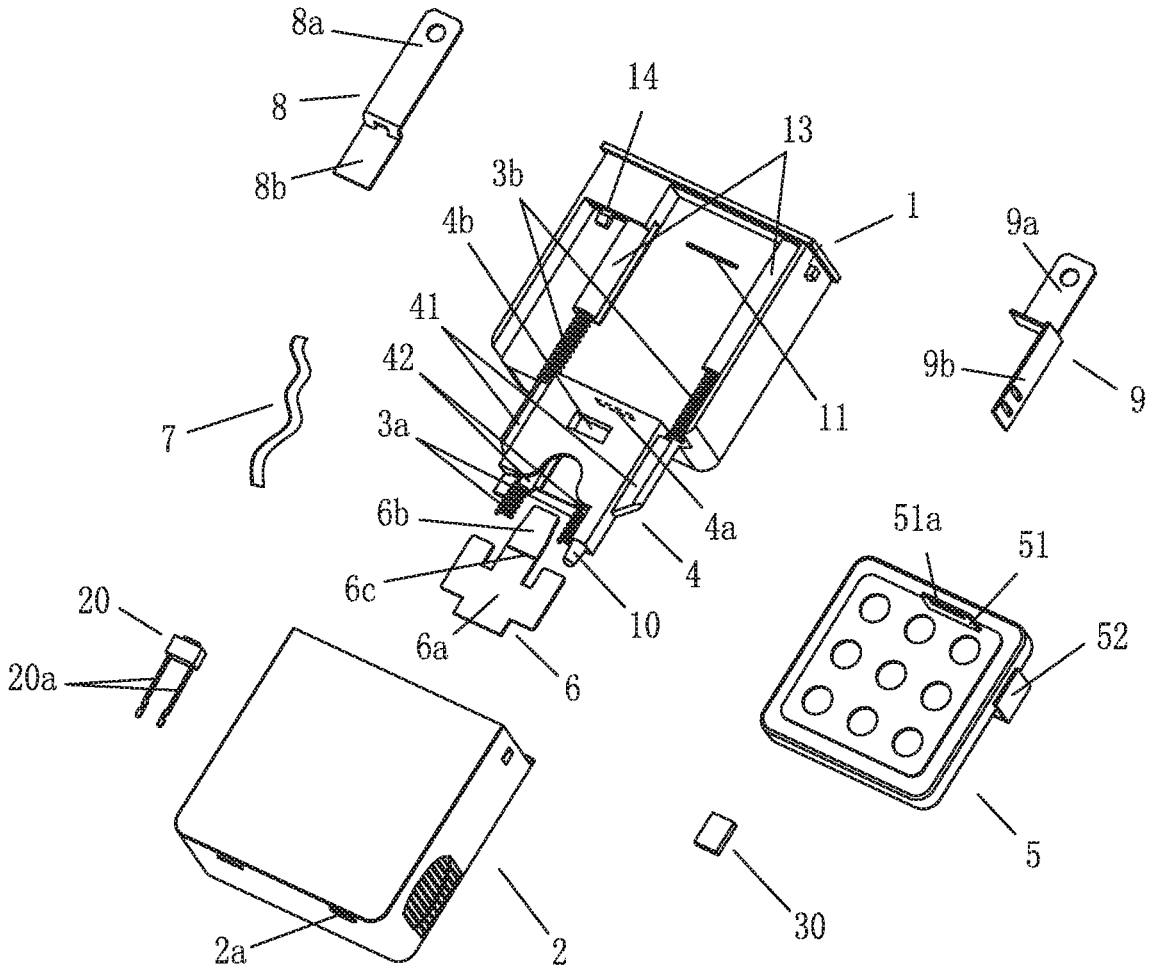
FIG. 1 is a disassembly diagram of an arc-preventing fast-breaking surge protection device according to Embodiment 1 of the present invention.

Parts corresponding to reference numeral: 1—inner shell; 1*a*—first cavity; 1*b*—second cavity; 1*c*—first end; 1*d*—second end; 11—electrode hole; 12—recess; 13—guide rail; 14—inserting groove; 15—blocking groove; 16—remote signaling gap; 17—stop block; 18—electrode baffle; 2—outer cover; 2*a*—indication window; 3—elastic element; 3*a*—first elastic member; 3*b*—second elastic member; 4—arc—preventing catapult; 4*a*—through hole; 4*b*—exhaust vent; 41—wing arm; 42—spring groove; 43—sliding groove; 5—voltage sensitive element; 51—front electrode; 51*a*—slotted hole; 52—back electrode; 6—tripping electrode; 6*a*—movable electrode slice; 6*b*—electrode welding end; 6*c*—breaking section; 7—flexible conductor; 8—first electrode pin; 9—second electrode pin; 8*a*—outer end of the first electrode pin; 8*b*—inner end of the first electrode pin; 9*a*—outer end of the second electrode pin; 9*b*—inner end of the second electrode pin; 10—indication module; 20—remote signaling alarm; 20*a*—alarm pin; 30—thermosensitive element.

DETAILED DESCRIPTION OF ILLUSTRATED EMBODIMENTS

The present invention will be further described in detail below with reference to the accompanying drawings and specific embodiments. However, the scope of the present invention is not limited to the following preferred embodiments, and the technical solution for enhancing the arc-breaking and insulation effect by catapulting and concealing tripping electrode in accordance with the present disclosure is within the protection scope thereof; the surge protection device of the present invention does not limit the material types of the voltage sensitive element, the elastic element, the first elastic member, the second elastic member and the flexible conductor; in the following specific embodiments, as is taken as examples to describe in detail the structure of the surge protection device of the present invention, the elastic element 3 is compression springs 3, the first elastic member 3*a* is first compression springs 3*a*, the second elastic member 3*b* is second compression springs 3*b*, the voltage sensitive element 5 is a varistor 5, and the flexible conductor 7 is a flexible copper wire 7.

Embodiment 1

Figure 2:
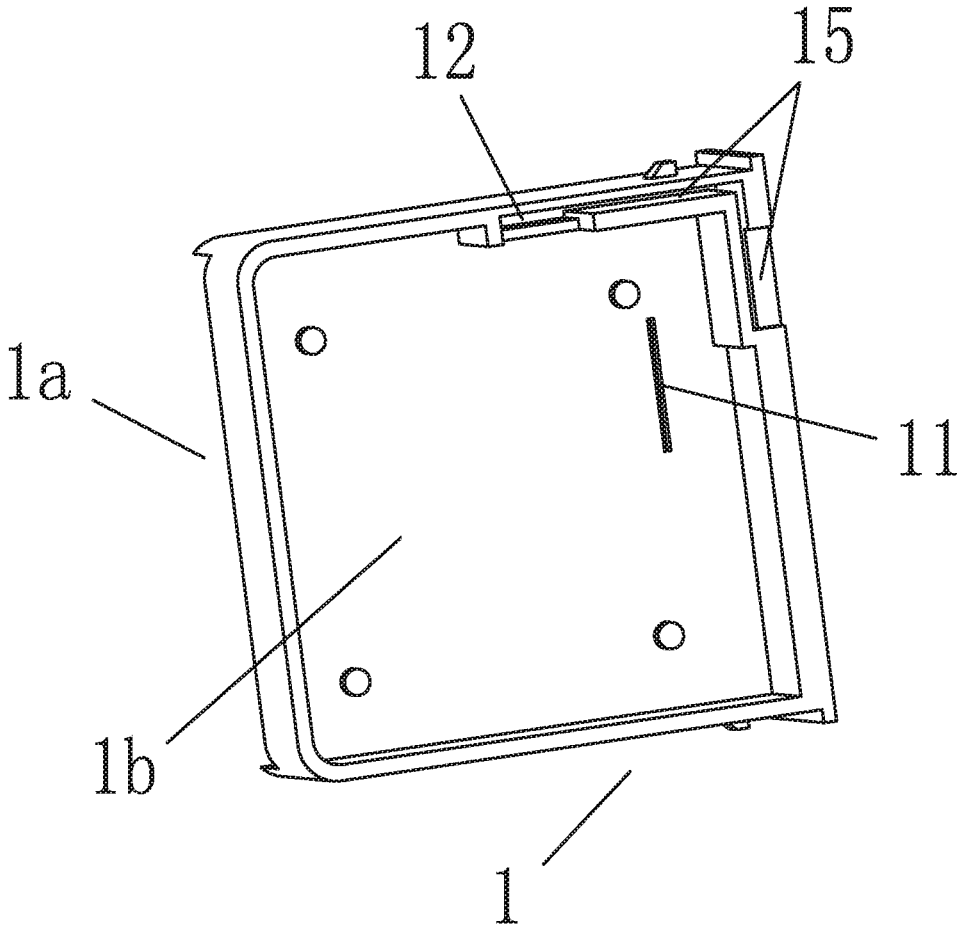
FIG. 2 is a back structure diagram of an inner shell according to Embodiment 1 of the present invention.

Referring now to FIG. 1 and FIG. 2, an arc-preventing fast-breaking surge protection device comprises an inner shell 1, an outer cover 2, two first compression springs 3*a*, two second compression springs 3*b*, an arc-preventing catapult 4, a varistor 5, a flexible copper wire 7, a first electrode pin 8, a second electrode pin 9, an indication module 10, a remote signaling alarm module 20 and a tripping electrode 6; the tripping electrode 6 is consist of a movable electrode slice 6*a*, a electrode welding end 6*b* and a breaking section 6*c*, and the movable electrode slice 6*a* is electrically connected with the electrode welding end 6*b* through the breaking section 6*c*. Both of the back silver electrode and the front silver electrode of the varistor 5 are provided with metal electrode slices by way of soldering, wherein one metal electrode slice is provided with a front electrode 51, a slotted hole 51*a* out of which the electrode welding end 6*b* protrudes is formed on the front electrode 51; a back electrode 52 is formed by an extending bending portion of the other metal electrode slice. The inner shell 1 has a frame structure. When the inner shell 1 and the outer cover 2 are engaged by a buckle, a first cavity 1*a* formed on the front surface of the inner shell 1, and a second cavity 1*b* is formed on the back surface of the inner shell 1. When the varistor 5 is placed in the second cavity 1*b*, the front electrode 51 protrudes into the first cavity 1*a* through the electrode hole 11 that penetrates the first cavity 1*a* and the second cavity 1*b*, as such, the slotted hole 51*a* is also located in the first cavity 1*a*; the back electrode 52 extends into the recess 12 on one side of the second cavity 1*b*. Two guide rails 13 perpendicular to the bottom of the inner shell 1 are disposed on both sides of the electrode hole 11 of the first cavity 1*a*, and the elongated slot openings of the two guide rails 13 are opposed to each other. An inserting groove 14 penetrating the bottom of the inner shell 1 is provided on the bottom of the side of the first cavity 1 farthest from the recess 12, a blocking groove 15 with L-shape structure and penetrating the bottom of the inner shell 1 is disposed on the side of the second cavity 1*b* closest to the recess 12, and the inner end of the blocking groove is communicated with the recess 12.

The arc-preventing catapult 4 with a box-like structure forms a cavity, and a spring groove 42 is provided on each side of the cavity. The front wall of the arc-preventing catapult 4 is provided with a through hole 42 out of which the electrode welding end 6*b* protrudes, and a wing arm 41 capable of being inserted into the guide rail 13 is provided on each side of the arc-preventing catapult 4. When the front electrode 51 protrudes out of the electrode hole 11, the arc-preventing catapult 4 slides along the guide rails 13 with the wing arm 41 of each side of the arc-preventing catapult 4 until touching the front electrode 51, as such, the positions of the through hole 4*a* and the slotted hole 51*a* face each other. The arc-preventing catapult 4 is further provided with an exhaust vent 4*b*. When the tripping electrode 6 is concealed in the cavity of the arc-preventing catapult 4 and the electrode welding end 6*b* protrudes out of the through hole 4*a*, the breaking section 6*c* faces the exhaust vent 4*b*.

In the present embodiment, the indication module 10 is a knockout pin which is disposed at the end of the arc-preventing catapult 4 and integral with the arc-preventing catapult 4. An indication window 2*a* is arranged in a corresponding position of the outer cover 2, out of which the indication module 10 may extends. The remote signaling alarm module 20 is an independent switch.

Figure 3:
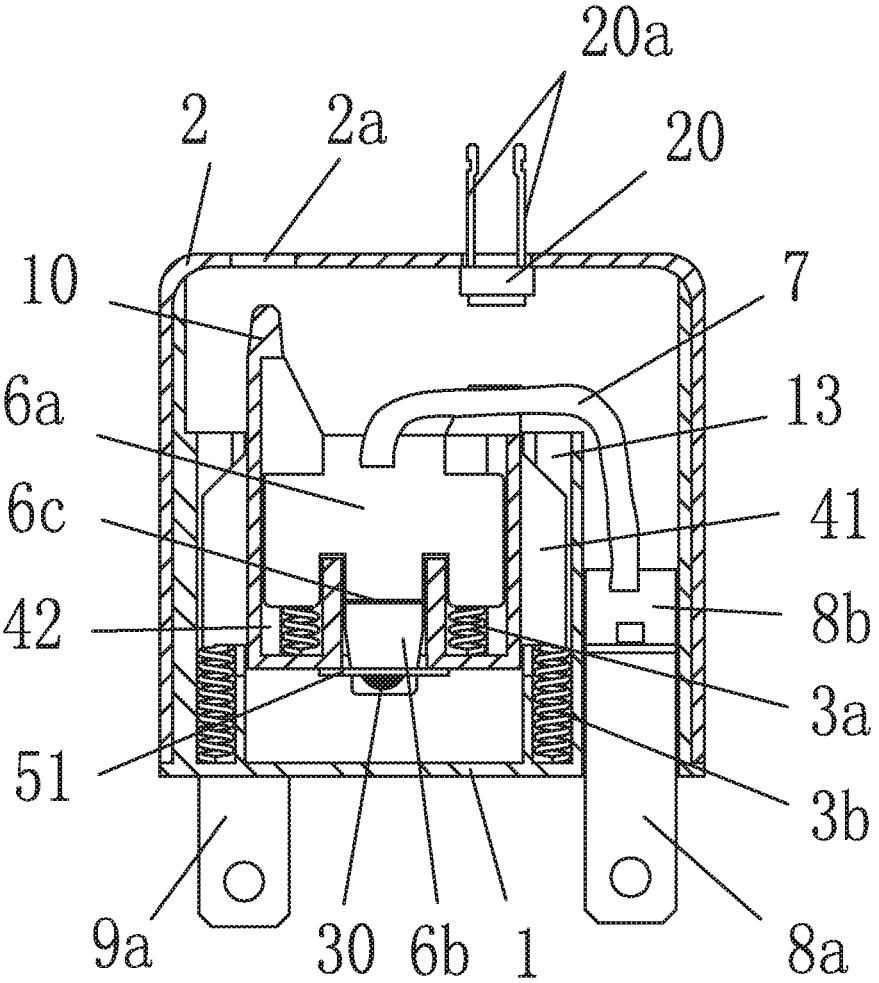
FIG. 3 is a cross-sectional view of a surge protection device in normal working state according to Embodiment 1 of the present invention.

As shown in FIG. 3, the remote signaling alarm module 20 is disposed in the outer cover 2, of which an alarm pin 20*a* extends out of the outer cover 2. The two second compression springs 3*b* are respectively arranged in the two guide rails 13, and the arc-preventing catapult 4 is inserted into the guide rails 41 through the side wing arms 41 until touching the front electrode 51, and the two second compression springs 3*b* are in compressed state. The two first compression springs 3*a* are respectively arranged in the two spring grooves 42, and the tripping electrode 6 inserted into the arc-preventing catapult 4 until the electrode welding end 6*b* protrudes out of the through hole 4*a* and the slotted hole 51*a*, and the movable electrode slice 6*a* compresses the two first compression spring 3*a* to be in compressed state. As such, the elastic stress of the first compression springs 3*a* is greater than the elastic stress of the second compression springs 3*b*. The electrode welding end 6*b* is electrically connected to the front electrode 51 through a thermosensitive element 30 by way of soldering; the first electrode pin 8 and the second electrode pin 9 are respectively fixed to the inner shell 1 through the inserting groove 14 and the blocking groove 15, and an outer end 8*a* of the first electrode pin 8 and an outer end 9*a* of the second electrode pin 9 extends outside the inner shell 1 to form external connection pins, and two ends of the flexible copper wire 7 are respectively electrically connected to the movable electrode slice 6*a* and an inner end 8*b* of the first electrode pin by metal alloy soldering or spot welding; the back electrode 52 is electrically connected to an inner end 9*b* of the first electrode pin 9 by metal alloy soldering, so that these electric conductors are connected in series with the varistor 5 to form a normally closed switch. When the surge protection device is employed in the power system, the two external connection pins are respectively connected to the phase line and the neutral line or the ground line. As such, the indication module 10 is located in the indication window 2*a*, and the switch of the remote signaling alarm module 20 is free from the compression of the external stress under the normal working state of the surge protection device.

Figure 4:
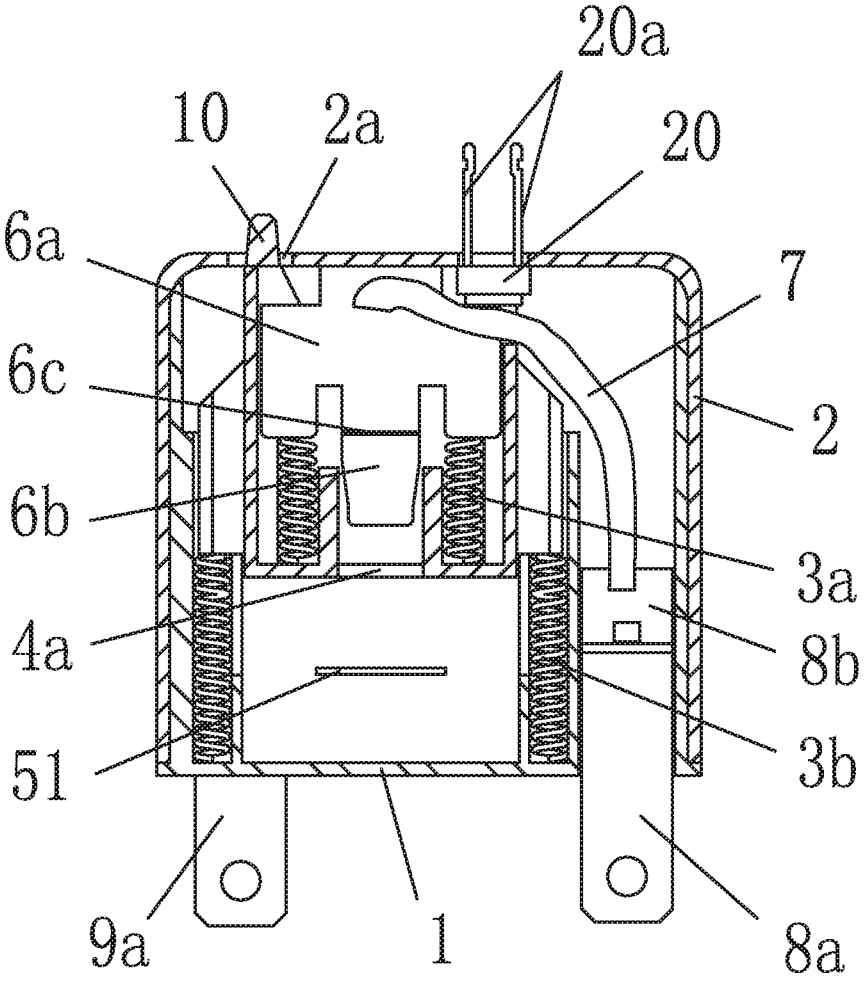
FIG. 4 is a cross-sectional view of a surge protection device after a thermal trip and breakdown according to Embodiment 1 of the present invention.

According to an embodiment of the present invention, when temperature of the varistor 5 is increased due to a short circuit current, an overloading current through circuits or a leakage current because of the aging thereof, the generated heat is transmitted to the front electrode 51, thus enabling the thermo sensitive element 30 to melt when reaching a preset temperature threshold. As shown in FIG. 4, the electrode welding end 6*b* is rapidly catapulted in the arc-preventing catapult 4 due to elastic stresses of the two first compression springs 3*a* on the movable electrode slice 6*a*; simultaneously the arc-preventing catapult 4 is rapidly catapulted in a direction away from the front electrode 51 due to elastic stresses of the two second compression springs 3*b*. Finally, the indication module 10 extends out of the indication window 2*a*, and the switch of the remote signaling alarm module 20 is compressed to be stationary by ends of the movable electrode slice 6*a* and the arc-preventing catapult 4, thereby causing its switch state to change. As Such, a mechanical indication for invalidation is realized, meanwhile a remote signal for indicating fault of the surge protection device is sent out. A sufficiently large dielectric strength is formed between the electrode welding end 6*b* and the front electrode 51, and the tripping electrode 6 and the front electrode 51 are completely isolated from each other.

Figure 5:
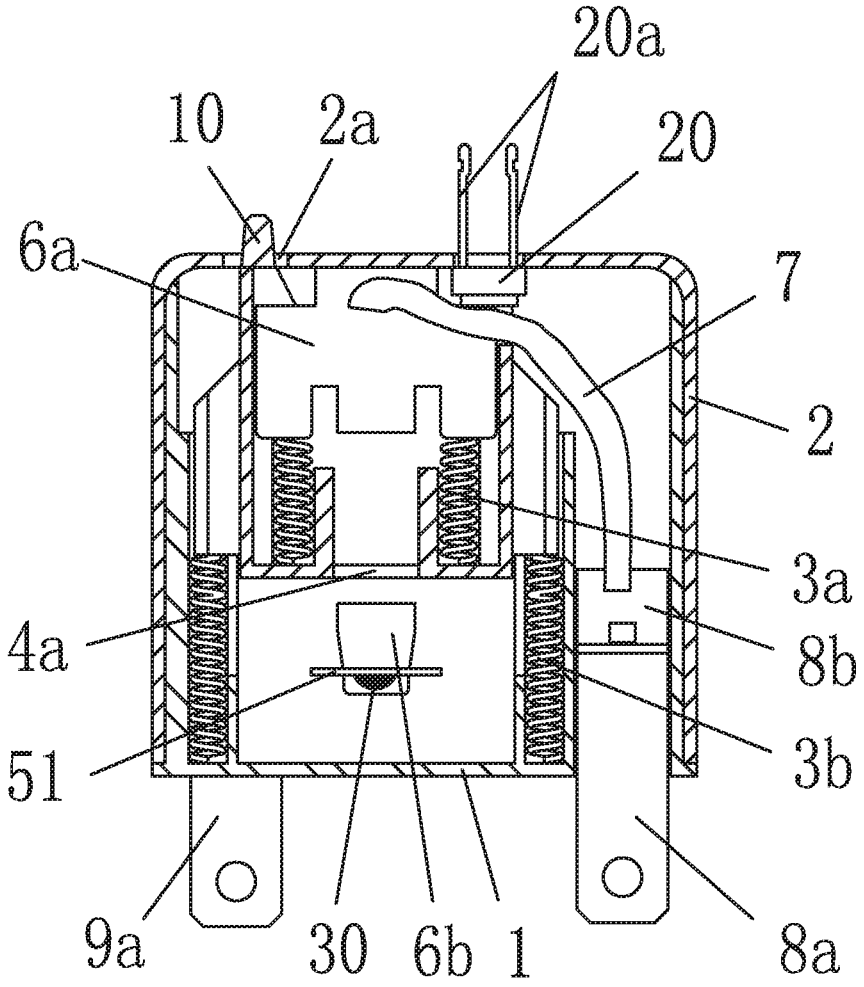
FIG. 5 is a cross-sectional view of a surge protection device after current is cut off according to Embodiment 1 of the present invention.

According to another embodiment of the present invention, when an instantaneous surge overvoltage, an overcurrent, a short circuit current or an overload current through the tripping electrode 6 exceeds a preset threshold value, the breaking section 6*c* of the tripping electrode instantaneously melts and vaporizes so that movable electrode slice 6*a* separates from the electrode welding end 6*b*. Referring to FIG. 5, the movable electrode slice 6*a* and the arc-preventing catapult 4 are simultaneously catapulted in a direction away from the front electrode 51 due to the elastic stresses of the first compression springs 3*a* and the second first compression springs 3*b*. At last, the indication module 10 extends out of the indication window 2*a*, and the switch of the remote signaling alarm module 20 is compressed to be stationary by ends of the movable electrode slice 6*a* and the arc-preventing catapult 4, thereby causing its switch state to change. As Such, a mechanical indication for invalidation is realized, meanwhile a remote signal for indicating failure of the surge protection device is sent out. In this way, the electrode welding end 6*b* separates from the movable electrode slice 6*a*. A sufficiently large dielectric strength is formed between the electrode welding end 6*b* and the movable electrode slice 6*a*, and the movable electrode slice 6*a* and the front electrode 51 are completely isolated from each other.

Embodiment 2

Another embodiment of an arc-preventing fast-breaking surge protection device of the present invention is as follows. This embodiment has similar structure and usage as most of the components of Embodiment 1, the main differences of them lie in the catapulting mode of the arc-preventing assembly, the structure of the tripping electrode 6 and the remote signaling alarm module 20 missing in the surge protection device.

Figure 6:
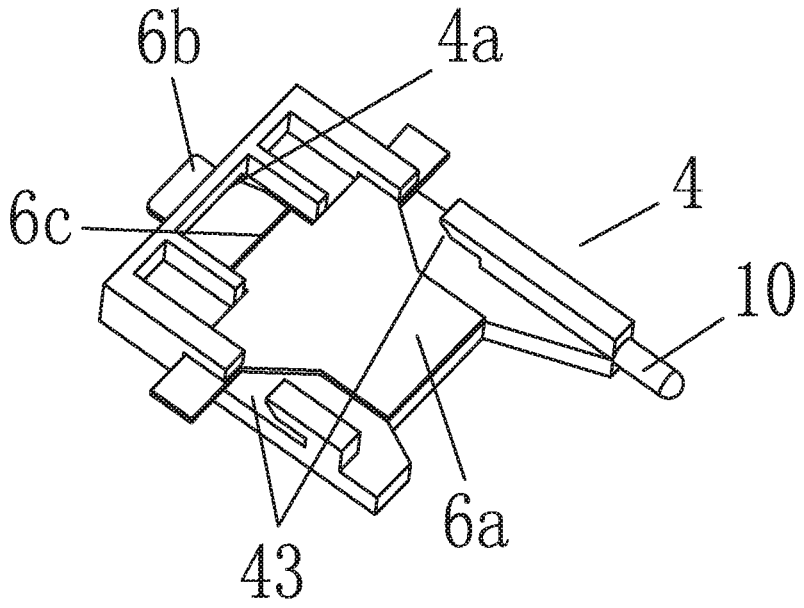
FIG. 6 is a combined structure diagram of an arc-preventing catapult and a tripping electrode according to Embodiment 2 of the present invention.

As shown in FIG. 6, the arc-preventing catapult 4 has a cavity structure with an open top, and a T-shaped sliding groove 43 is formed on each side wall of the arc-preventing catapult 4, and the extending portion of each side of the movable electrode slice 6*a* of the tripping electrode 6 passes through the sliding groove 43 and extends out of the arc-preventing catapult 4, and a front wall of the arc-preventing catapult 4 is provided with a through hole 4*a* out of which the electrode welding end 6*b* extends. When the extending portion of each side of the movable electrode slice 6*a* slides to a front end of the sliding groove 43, the electrode welding end 6*b* protrudes out of the arc-preventing catapult 4 through the through hole 4*a*, and the indication module 10 is a knockout pin which is disposed at the end of the arc-preventing catapult 4 and integral with the arc-preventing catapult 4.

Figure 7:
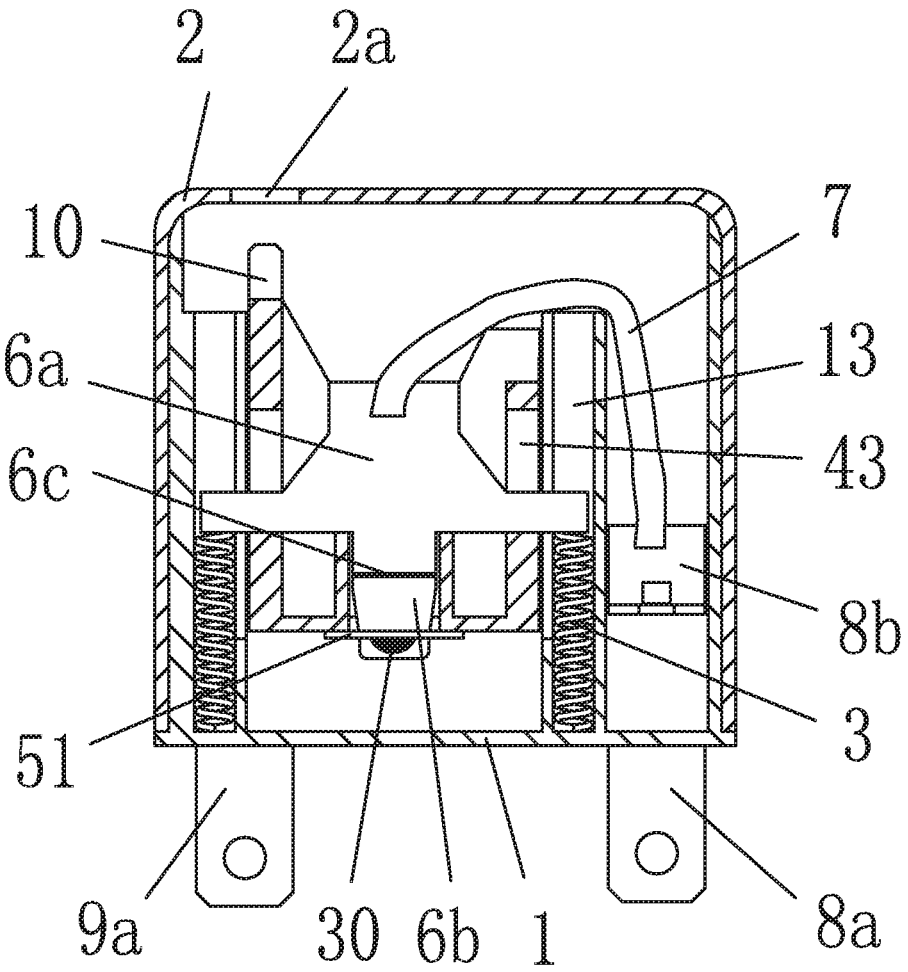
FIG. 7 is a cross-sectional view of a surge protection device in normal working state according to Embodiment 2 of the present invention.

The structure shown in FIG. 6 is replaced with the corresponding structure in FIG. 3. As shown in FIG. 7, two compression springs 3 are respectively placed in the two guide rails 13, and the extending portion of each side of the movable electrode slice 6*a* is inserted into the guide rail 13 and drives the arc-preventing catapult 4 until toughing the front electrode 51. In this way, the electrode welding end 6*b* protrudes out of the through hole 4*a* and the slotted hole 51*a*, and the movable electrode slice 6*a* presses the two compression springs 3 to be in compressed state. The electrode welding end 6*b* is electrically connected to the front electrode 51 through a thermosensitive element 30 by way of soldering. When the surge protection device is employed in the power system, the two external connection pins are respectively connected to the phase line and the neutral line or the ground line. As such, the indication module 10 is compressed in the indication window 2*a* under the normal working state of the surge protection device.

Figure 8:
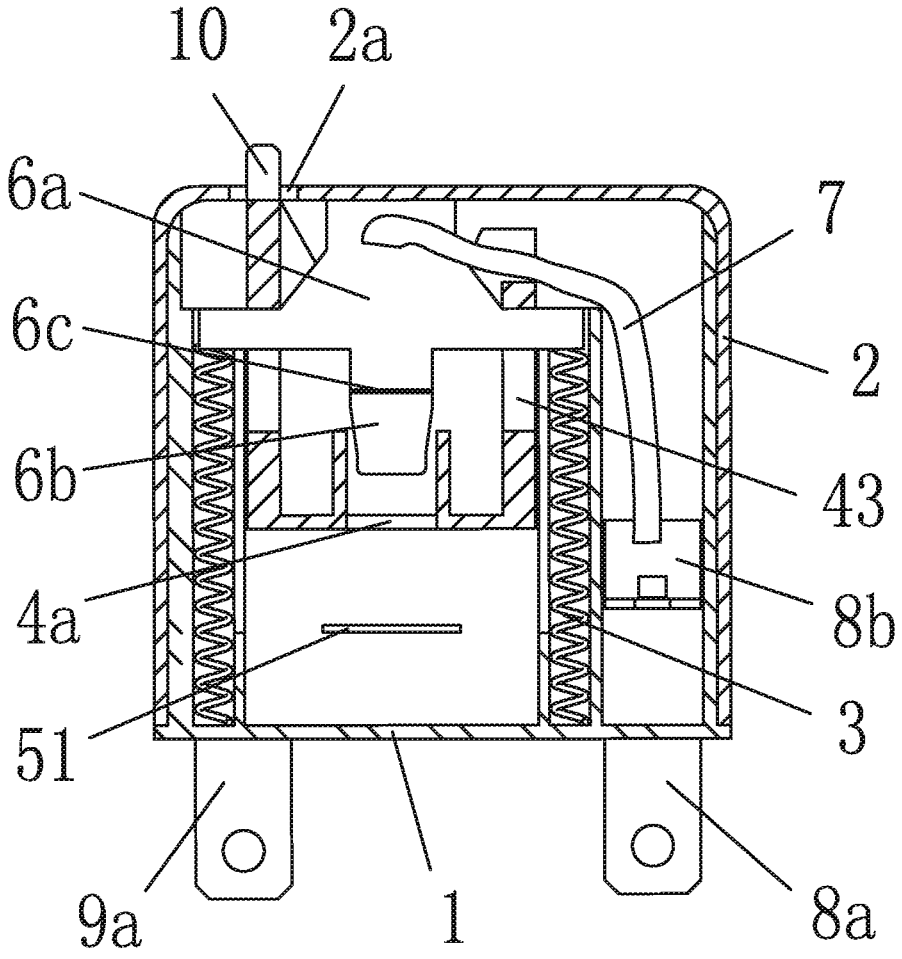
FIG. 8 is a cross-sectional view of a surge protection device after a thermal trip and breakdown according to Embodiment 2 the present invention.

According to illustrative example of the present invention, when temperature of the varistor 5 is increased due to a short circuit current, an overloading current through circuits or a leakage current because of the aging of the varistor 5, the generated heat is transmitted to the front electrode 51, thus enabling the thermosensitive element 30 to melt when reaching a preset temperature threshold. As shown in FIG. 8, the electrode welding end 6*b* is rapidly catapulted in the through hole 4*a* due to elastic stresses of the compression springs 3 on the movable electrode slice 6*a*; the extending portion of each side of the movable electrode slice slides to end of the sliding groove 43 and drives the arc-preventing catapult 4 to continuously catapult in a direction away from the front electrode 51. At last, the indication module 10 extends out of the indication window 2*a* and is blocked to be stationary. As Such, a mechanical indication for invalidation is realized. A sufficiently large dielectric strength is formed between the electrode welding end 6*b* and the through hole 4*a*, the through hole 4*a* and the front electrode 51, and the tripping electrode 6 and the front electrode 6*b* are completely isolated from each other.

Figure 9:
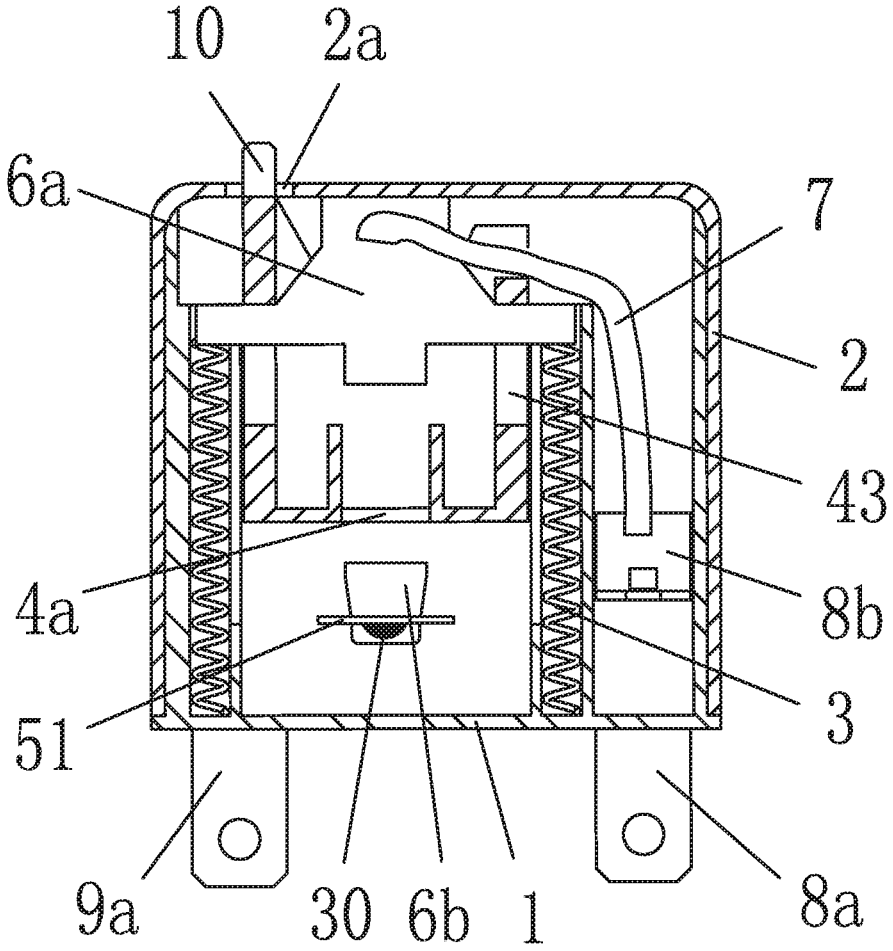
FIG. 9 is a cross-sectional view of a surge protection device after current is cut off according to Embodiment 2 of the present invention.

According to another embodiment of the present invention, when an instantaneous surge overvoltage, an overcurrent, or short circuit current or overload current through the tripping electrode 6 exceeds a preset threshold value, the breaking section 6*c* of the tripping electrode 6 instantaneously melts and vaporizes so that movable electrode slice 6*a* separates from the electrode welding end 6*b*. Referring to FIG. 9, the movable electrode slice 6*a* is catapulted in a direction away from the front electrode 51 due to the elastic stresses of the compression springs, and then the extending portion of each side of the movable electrode slice 6*a* slides to end of the sliding groove 43 and drives the arc-preventing catapult 4 to continuously catapult in a direction away from the front electrode 51. At last, the indication module 10 extends out of the indication window 1*a* and is blocked to be stationary. As Such, a mechanical indication for invalidation is realized. A sufficiently large dielectric strength is formed between the electrode welding end 6*b* and the through hole 4*a*, the through hole 4*a* and the movable electrode slice 6*a*, and the movable electrode slice 6*a* and the front electrode are completely isolated from each other.

Embodiment 3

Another embodiment of an arc-preventing fast-breaking surge protection device of the present invention is as follows. This embodiment has similar structure and usage as most of the components of Embodiment 2, the main differences of them lie in the catapulting mode of the arc-preventing assembly and the indication module 10 and the indication window 1*a* missing in the surge protection device.

Figure 10:
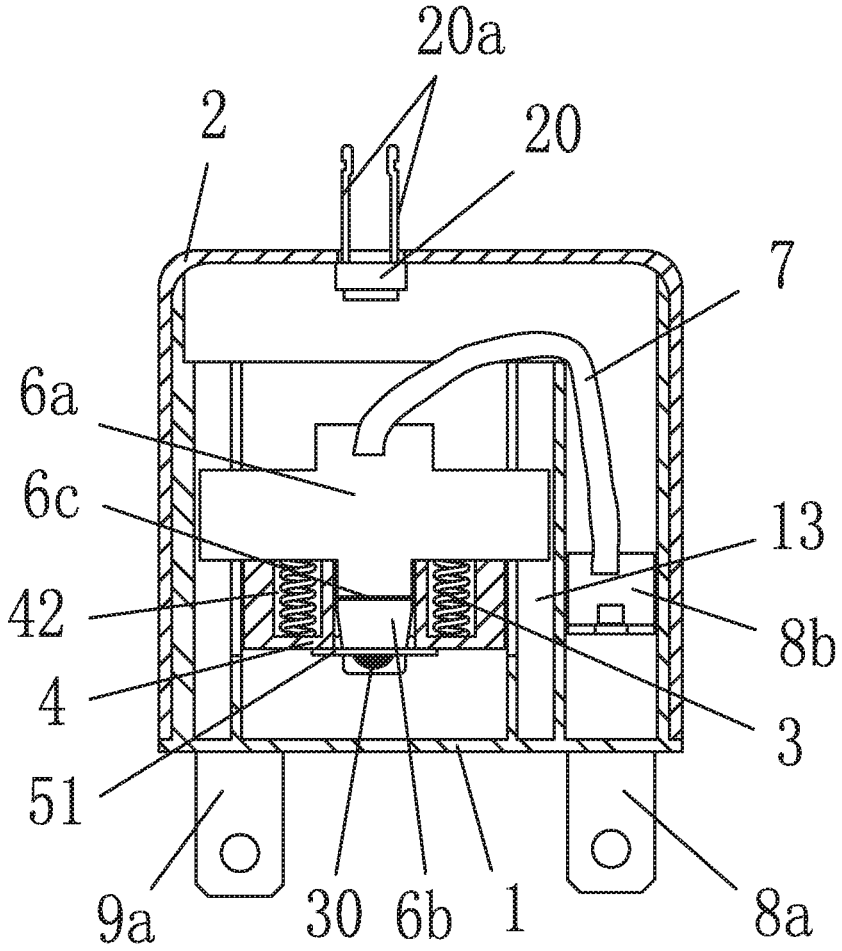
FIG. 10 is a cross-sectional view of a surge protection device in normal working state according to Embodiment 3 of the present invention.

As shown in FIG. 10, the remote signaling alarm module 20 is disposed in the outer cover 2, of which an alarm pin 20*a* extends out of the outer cover 2. The arc-preventing catapult 4 is a baffle, which is vertically fixed under the electrode hole 11. The baffle is provided with a through hole 4*a* out of which the electrode welding end 6*b* protrudes, and a spring groove 42 is provided on each side of the through hole 4*a*. Two compression springs 3 are respectively arranged in the two spring grooves 42. The extending portion of each side of the movable electrode slice 6*a* is inserted into the guide rail 13 until the electrode welding end 6*b* protrudes out of the through hole 4*a* and the slotted hole 51*a*; the movable electrode piece 6*a* presses the two compression springs 3 to be in compressed state. The electrode welding end 6*b* is electrically connected to the front electrode 51 through a thermosensitive element 30 by way of soldering. When the surge protection device is employed in the power system, the two external connection pins are respectively connected to the phase line and the neutral line or the ground line. As such, the switch of the remote signaling alarm module 20 is free from the compression of the external stress under the normal working state of the surge protection device.

Figure 11:
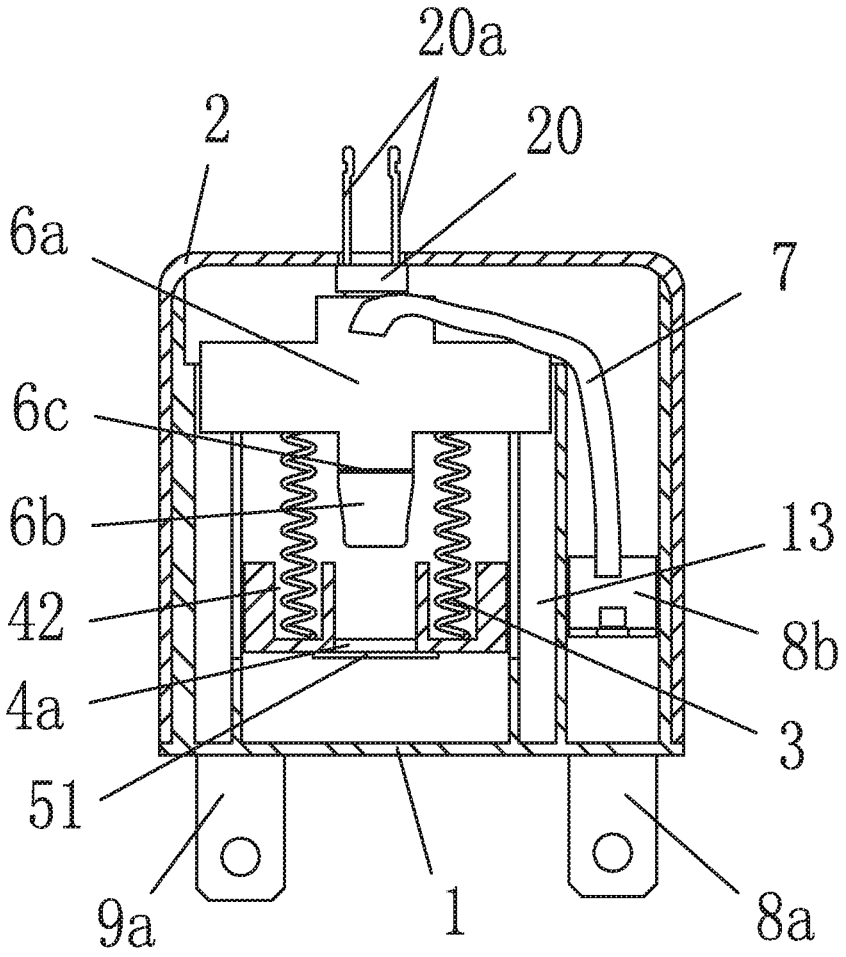
FIG. 11 is a cross-sectional view of a surge protection device after a thermal trip and breakdown according to Embodiment 3 the present invention.

According to an embodiment of the present invention, when temperature of the varistor 5 is increased due to a short circuit current, an overloading current through circuits or a leakage current because of the aging of the varistor 5, the generated heat is transmitted to the front electrode 51, thus enabling the thermosensitive element 30 to melt when reaching a preset temperature threshold. As shown in FIG. 11, the electrode welding end 6*b* is rapidly catapulted in the through hole 4*a* by the movable electrode slice 6*a* due to an elastic stress of the compression springs 3 and catapulted continuously in a direction away from the front electrode 51. At last, the switch of the remote signaling alarm module 20 is compressed to be stationary by end of the movable electrode slice 6*a*, thereby causing its switch state to change, and then a remote signal for indicating fault of the surge protection device is sent out. A sufficiently large dielectric strength is formed between the electrode welding end 6*b* and the through hole 4*a*, and the tripping electrode 6 and the front electrode 51 are completely isolated from each other.

Figure 12:
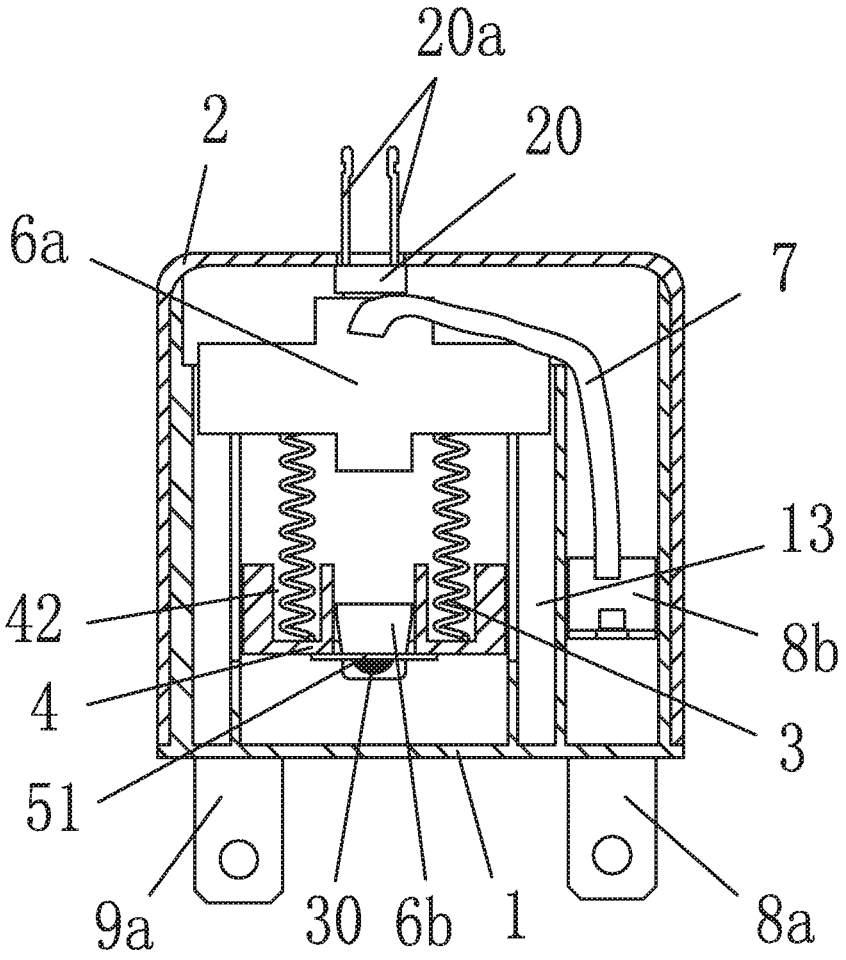
FIG. 12 is a cross-sectional view of a surge protection device after current is cut off according to Embodiment 3 of the present invention.

According to another embodiment of the present invention, when an instantaneous surge overvoltage, an overcurrent, a short circuit current or overload current through the tripping electrode 6 exceeds a preset threshold value, the breaking section 6*c* of the tripping electrode 6 instantaneously melts and vaporizes so that the movable electrode slice 6*a* separates from the electrode welding end 6*b*. Referring to FIG. 12, the movable electrode slice 6*a* is catapulted in a direction away from the front electrode 51 due to the elastic stresses of the compression springs 3, At last, the switch of the remote signaling alarm module 20 is compressed and blocked to be stationary by end of the movable electrode slice 6*a*, thereby causing its switch state to change, then a remote signal for indication fault of the surge protection device is sent out. A sufficiently large dielectric strength is formed between the electrode welding end 6*b* and the movable electrode slice 6*a*, and the movable electrode slice 6*a* and the front electrode 51 are completely isolated from each other Embodiment 4

Another embodiment of an arc-preventing fast-breaking surge protection device of the present invention is as follows. This embodiment has similar structure and usage as most of the components of Embodiment 1, the main differences of them lie in the structure of the tripping and the indicating modes for working state of the surge protection device.

Figure 13:
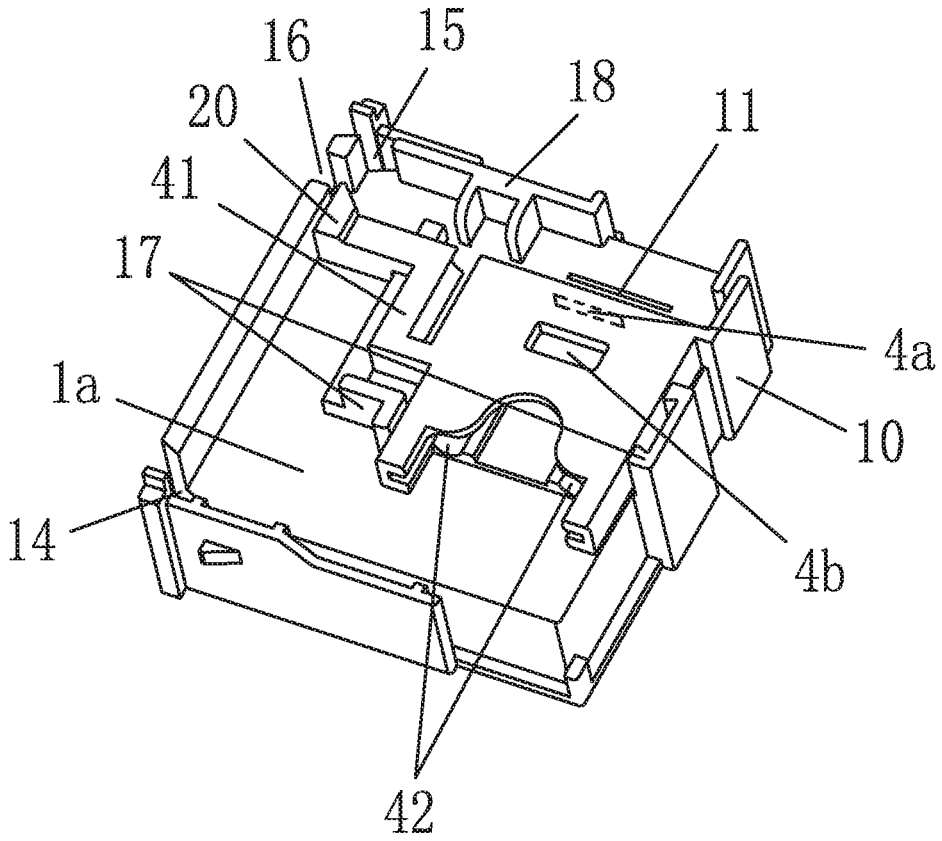
FIG. 13 is a combined structure diagram of an arc-preventing catapult and a tripping electrode according to Embodiment 4 of the present invention.

As shown in FIG. 13, the arc-preventing catapult 4 with a box-like structure forms a cavity, and a spring groove 42 is provided on each side of the cavity. The front wall of the arc-preventing catapult 4 is provided with a through hole 4*a* out of which electrode welding end protrudes 6*b*. The arc-preventing catapult 4 is further provided with an exhaust vent 4*b*. The indication module 10 with baffle structure is disposed on one side of the arc-preventing catapult 4, and the other side of the arc-preventing catapult 4 extends a wing arm 41 that can be provided with a spring. The remote signaling alarm module 20 is a bump disposed at the end of the wing arm 41. A remote signaling gap 16 is formed at the bottom of the first cavity 1*a* f the inner shell 1, and two stop blocks 17 and an electrode baffle 18 that can be provided with a spring are disposed on the first cavity 1*a*.

Figure 14:
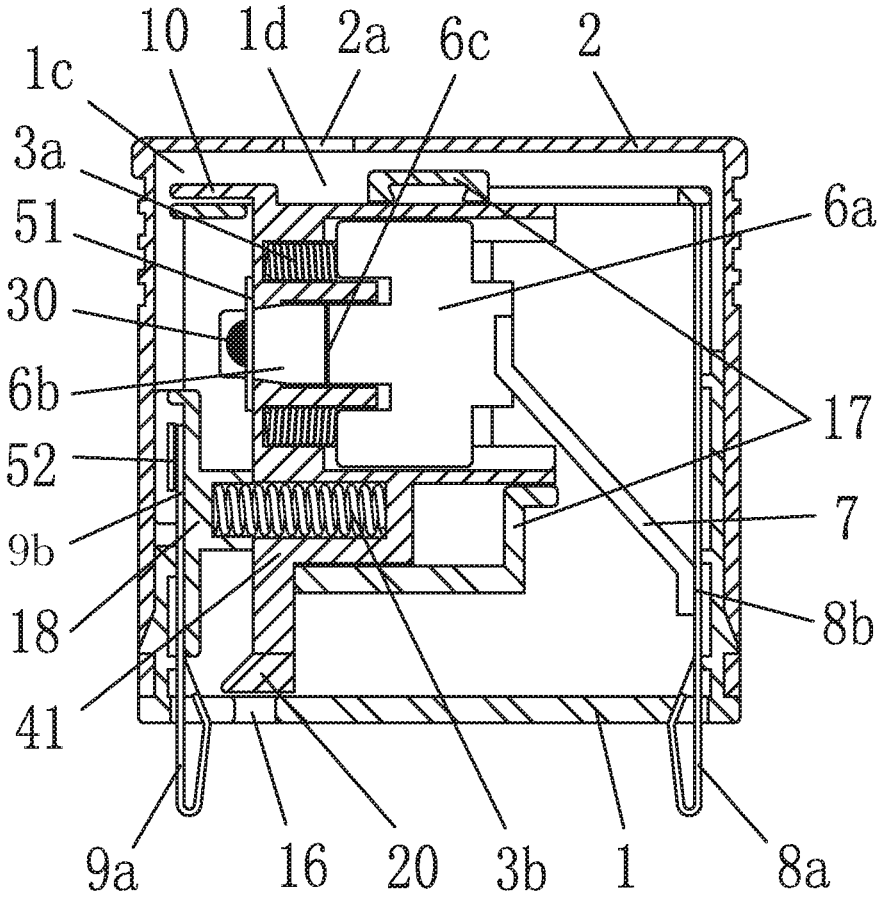
FIG. 14 is a cross-sectional view of a surge protection device in normal working state according to Embodiment 4 of the present invention.

As shown in FIG. 14, two ends of a second compression spring 3*b* are respectively fixed on the electrode baffle 18 and the wing arm 41, and the arc-preventing catapult 4 is orientated by the stop blocks 17 until touching the front electrode. The second compression spring 3*b* is in compressed state. The two first compression springs 3*a* are respectively placed in the two spring grooves 4*a*, and the tripping electrode 6 is inserted into the arc-preventing catapult 4 until the electrode welding end 6*b* protrudes out of the through hole 4*a* and the slotted hole Ma. The movable electrode slices 6*a* compress the two first compression springs 3*a* to be in compressed state. As such, the elastic stress of the first compression spring 3*a* is greater than the elastic stress of the second compression spring 3*b*. The electrode welding end 6*b* is electrically connected to the front electrode 51 through the thermosensitive element 30 by way of soldering. When the surge protection device is employed in the power system, the two external connection pins are respectively connected to the phase line and the neutral line or the ground line. As such, the remote signaling alarm module 20 blocks the remote signaling gap 16, and the indication module 10 is at the first end 1*c* of outer wall of inner shell 1. The indication window 2*a* faces the second end 1*d* of outer wall of inner shell 1 under the normal working state of the surge protection device.

Figure 15:
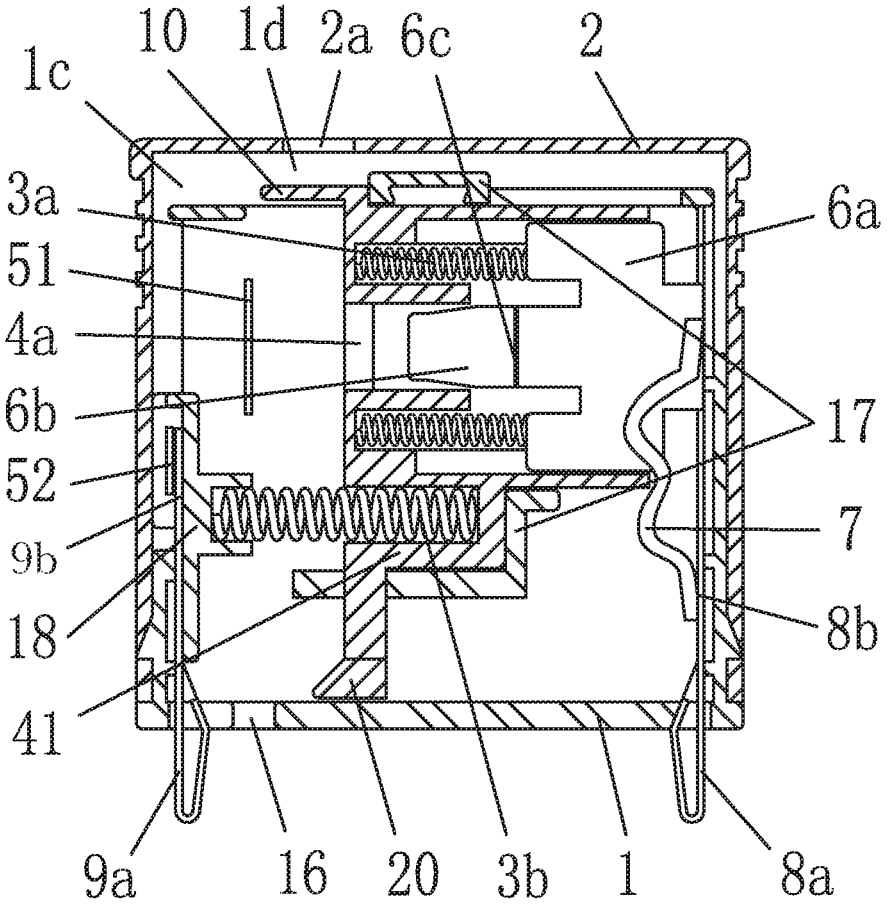
FIG. 15 is a cross-sectional view of a surge protection device after a thermal trip and breakdown according to Embodiment 4 the present invention.

According to an embodiment of the present invention, when temperature of the varistor 5 is increased due to the short circuit and overloading current through circuits and the leakage current because of the aging thereof, the generated heat is transmitted to the front electrode 51, thus enabling the thermosensitive element 30 to melt when reaching a preset temperature threshold. As shown in FIG. 15, the electrode welding end 6*b* is rapidly catapulted in the arc-preventing catapult 4 due to elastic stresses of the first compression springs 3*a* on the movable electrode slice 6*a*; meanwhile the arc-preventing catapult 4 is rapidly catapulted in a direction away from the front electrode 51 due to an elastic stress of the second compression spring 3*b*. As a result, the remote signaling alarm module 20 is misaligned with the remote signaling gap 16, and the indication module 10 is moved to the second end 1*d* and blocked to be stationary, thus realizing a mechanical indication for invalidation, a sufficiently large dielectric strength is formed between the through hole 4*a* and the electrode welding end 6*b* and between the front electrode 51 and the through hole 4*a*, and the tripping electrode 6 and the front electrode 51 are completely isolated from each other.

Figure 16:
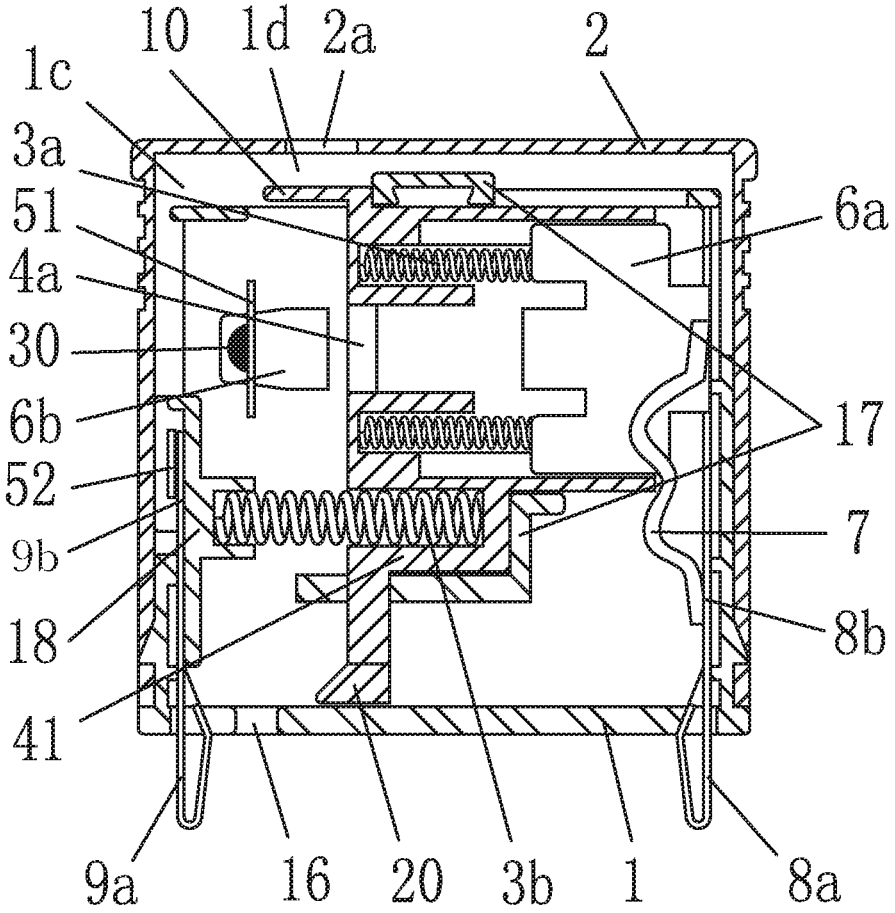
FIG. 16 is a cross-sectional view of a surge protection device after current is cut off according to Embodiment 4 of the present invention.

According to another embodiment of the present invention, when an instantaneous surge overvoltage, an overcurrent, a short circuit current or an overload current through the tripping electrode 6 exceeds a preset threshold value, the breaking section 6*c* of the tripping electrode 6 instantaneously melts and vaporizes so that movable electrode slice 6*a* separates from the electrode welding end 6*b*. Referring to FIG. 16, the movable electrode slice 6*a* and the arc-preventing catapult 4 are simultaneously catapulted in a direction away from the front electrode 51 due to the elastic stresses of the first compression springs 3*a* and the second first compression spring 3*b*. At last, the remote signaling alarm module 20 is misaligned with the remote signaling gap 16, and the indication module 10 is moved to the second end 1*d* and blocked to be stationary, thus realizing a mechanical indication for invalidation, a sufficiently large dielectric strength is formed between the through hole 4*a* and the electrode welding end 6*b* and between the movable electrode slice 6*a* and the through hole 4*a*, and the movable electrode slice 6*a* and the front electrode 51 are completely isolated from each other.

Preferably, the outer surface of the indication module 10 can be coated with a bold color, such as red color. When the indication module 10 is moved from the first end 1*c* to the second end 1*d*, color change can be observed from the indication window 2*a*, thereby indicating protection failure of the varisto 5; meanwhile, if a user utilizes the remote signaling alarm module 20 to trigger a switch passing through the remote signaling gap 16 on the assembling platform. When the remote signal alarm module 20 that originally blocked the remote signal gap 16 and compressed a button of the switch is misaligned with the remote signaling gap 16, the button of the switch isn't compressed any longer, and the switch state of the switch changes immediately, thereby sending out a remote signal for indicating validation of the surge protection device.

Embodiment 5

Figure 17:
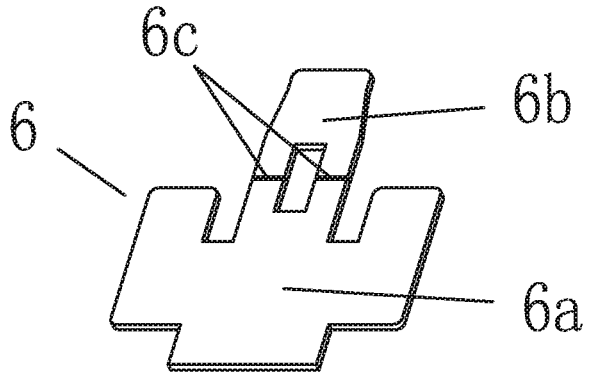
FIG. 17 is a view showing a special structure of a tripping electrode according to the present invention.

As shown in FIG. 17, it is an alternative example to the tripping electrode. The movable electrode slice 6*a*, the electrode welding end 6*b*, and the breaking section 6*c* are different portions of the same alloy. To limit the cross-sectional area of the breaking section 6*c* to ensure that it can be cut off at the breaking section 6*c* when an instantaneous surge overvoltage, an overcurrent, a short circuit current or overloading current through the tripping electrode 6 exceeds its threshold value, the breaking section is designed as indentation shape, and a notch is formed on a copper piece near the breaking section 6*c* to limit the length of the breaking section 6*c*.

The features or combinations of features described in the above embodiments may be present separately or may be combined with features or combinations of features in other embodiments. According to instantaneous catapult to separate and conceal the tripping electrode and adopting the metal material to realize breaking function of the short circuit overload current in the present disclosure, those skilled in the art can made various modifications or changes to the above embodiments, which are all within the scope of protection of the present invention.

What is claimed is:

1. An arc-preventing fast-breaking surge protection device, wherein the device comprises:

an arc-preventing assembly comprising an arc-preventing catapult (4) and an elastic element (3);

a voltage sensitive assembly comprising at least one voltage sensitive element (5);

a response switch assembly comprising a thermosensitive element (30), a front electrode (51) and a tripping electrode (6), the tripping electrode (6) being consisted of a movable electrode slice (6*a*), an electrode welding end (6*b*) and a breaking section (6*c*), the breaking section (6*c*) being respectively electrically connected the movable electrode slice (6*a*) and the electrode welding end (6*b*);

electrode pins comprising a flexible conductor (7), a first electrode pin (8) and a second electrode pin (9); and a housing comprising an inner shell (1) and an outer cover (2);

wherein the response switch assembly is a normally closed switch in a normal operating state, the thermosensitive element (30) is electrically connected in series and tightly thermally coupled with the voltage sensitive assembly; when the thermosensitive element (30) melts as the thermosensitive element reaches a preset melting temperature, the tripping electrode (6) is separated from the front electrode (51) due to an elastic stress of the elastic element (3), the tripping electrode (6) is rapidly catapulted and concealed in the arc-preventing catapult (4), meanwhile the arc-preventing catapult (4) is rapidly catapulted in a direction away from the front electrode (51) due to an elastic stress of the elastic member (3), thereby preventing arc generated during instantaneous catapulting of the tripping electrode (6) from forming an electrical breakdown and causing a short circuit and an overload;

wherein when an instantaneous surge overvoltage, an overcurrent, a short circuit current or an overloading current through the breaking section (6*c*) exceeds a preset threshold value, the breaking section (6*c*) instantaneously melts and vaporizes so that the movable electrode slice (6*a*) separates from the electrode welding end (6*b*), while the arc-preventing catapult (4) and the movable electrode slice (6*a*) are rapidly catapulted in a direction away from the front electrode (51) due to the elastic stress of the elastic element (3), the movable electrode slice (6*a*) is concealed in the arc-preventing catapult (4), thus preventing arc generated during instantaneous melting and catapulting from forming an electrical breakdown and causing a short circuit and an overload;

wherein a first cavity (1*a*) and a second cavity (1*b*) are formed when the inner shell (1) is engaged with the outer cover (2), the arc-preventing assembly and the response switch assembly is arranged in the first cavity (1*a*), the voltage sensitive element (5) is arranged in the second cavity (1*b*);

wherein two metal electrode slices are respectively disposed on both sides of the voltage sensitive element (5), the front electrode (51) is disposed on one of the metal electrode slices, the front electrode (51) protrudes from the second cavity (1*b*) to the first cavity (1*a*), the other metal electrode slice is provided with a back electrode (52), the back electrode is in the second cavity (1*b*);

wherein the elastic element (3) is consisted of a first elastic member (3*a*) and a second elastic member (3*b*), the first elastic member (3*a*) is disposed on the arc-preventing catapult (4), the second elastic member (3*b*) is disposed in the first cavity (1*a*);

wherein the first cavity (1*a*) is provided with an inserting groove (14), and the second cavity (1*b*) is provided with a blocking groove (15); the first electrode pin (8) enters the first cavity (1*a*) through the inserting groove (14), and the second electrode pin (9) enters the second cavity (1*b*) through the blocking groove (15); two ends of the flexible conductor (7) are respectively electrically connected to the movable electrode slice (6*a*) and an inner end (8*b*) of the first electrode pin (8) by metal alloy soldering or spot welding, the back electrode (52) is electrically connected to an inner end (9*b*) of the second electrode pin (9) by metal alloy soldering; an outer end (8*a*) of the first electrode pin (8) and an outer end (9*a*) of the second electrode pin (9) extends out of the inner shell (1) to form external connection pins;

wherein the front electrode (51) is provided with a slotted hole (51*a*); the tripping electrode (6) is concealed in the arc-preventing catapult (4), the movable electrode slice (6*a*) of the tripping electrode (6) is misaligned by the first elastic member (3*a*); the arc-preventing catapult (4) thereon is misaligned by the second elastic member (3*b*);

wherein a front end of the arc-preventing catapult (4) is provided with a through hole (4*a*) which is a port out of which the electrode welding end (6*b*) protrudes; when the arc-preventing catapult (4) contacts with the front electrode in the first cavity (1*a*), the through hole (4*a*) faces the position of the slotted hole (51*a*); the arc-preventing catapult (4) is provided with an exhaust vent (4*b*), when the tripping electrode (6) is disposed in the arc-preventing catapult (4) and the electrode welding end (6*b*) protrudes out of the through hole (4*a*), the breaking section (6*c*) faces the position of the exhaust vent (4*b*).

2. The arc-preventing fast-breaking surge protection device according to claim 1, wherein the electrode welding end (6*b*) protrudes out of the through hole (4*a*) and the slotted hole (51*a*), and is electrically connected to the front electrode (51) through the thermosensitive element (30) by soldering.

3. The arc-preventing fast-breaking surge protection device according to claim 2, wherein when the electrode welding end (6*b*) separates from the front electrode (51) due to thermal melting of the thermosensitive element (30) reaching the preset melting temperature, the tripping electrode (6) is catapulted back and concealed in the arc-preventing catapult (4) due to an elastic stress of the first elastic member (3*a*), while the arc-preventing catapult (4) is catapulted in a direction away from the front electrode (51) due to an elastic stress of the second elastic member (3*b*).

4. The arc-preventing fast-breaking surge protection device according to claim 3, wherein the arc-preventing fast-breaking surge protection device further comprises an indication module (10) for indicating a state of the arc-preventing fast-breaking surge protection device and a remote signaling alarm module (20) for indicating a state of the arc-preventing fast-breaking surge protection device;

wherein the indication module (10) is an electrical indication module or a mechanical indication module;

wherein the outer cover (2) is provided with an indication window (2*a*).

5. The arc-preventing fast-breaking surge protection device according to claim 2, wherein when the instantaneous surge overvoltage, the overcurrent, the short circuit current or the overloading current through the tripping electrode (6)

exceeds the preset threshold value, the breaking section (6*c*) of the tripping electrode (6) instantaneously melts and vaporizes so that the movable electrode slice (6*a*) separates from the electrode welding end (6*b*), while the movable electrode slice (6*a*) is rapidly catapulted in a direction away from the electrode welding end (6*b*) due to an elastic stress of the first elastic member (3*a*), the arc-preventing catapult (4) is rapidly catapulted in a direction away from the front electrode (51) due to an elastic stress of the second elastic member (3*b*), the movable electrode slice (6*a*) is concealed in the arc-preventing catapult (4).

6. The arc-preventing fast-breaking surge protection device according to claim 5, wherein the arc-preventing fast-breaking surge protection device further comprises an indication module (10) for indicating a state of the arc-preventing fast-breaking surge protection device and a remote signaling alarm module (20) for indicating a state of the arc-preventing fast-breaking surge protection device;

wherein the indication module (10) is an electrical indication module or a mechanical indication module;

wherein the outer cover (2) is provided with an indication window (2*a*).

7. The arc-preventing fast-breaking surge protection device according to claim 1, wherein the thermosensitive element (30) is a fusible metal alloy solder or a conductive polymer;

wherein the breaking section (6*c*) is a metal alloy material which is vaporized instantaneously after melting.

8. The arc-preventing fast-breaking surge protection device according to claim 1, wherein the voltage sensitive element (5) adopts a varistor sensitive element, a discharge tubular sensitive element, or a discharge gap sensitive element.

* * * * *